US006394080B1

(12) United States Patent
Zavala

(10) Patent No.: US 6,394,080 B1
(45) Date of Patent: May 28, 2002

(54) ROAD SURFACE CUTTING SYSTEM AND METHOD FOR PERFORMING SAME

(75) Inventor: Alfredo Zavala, Elgin, IL (US)

(73) Assignee: Marking Specialist Corp, South Elgin, IL (US)

( * ) Notice: Subject to any disclaimer, the term of this patent is extended or adjusted under 35 U.S.C. 154(b) by 0 days.

(21) Appl. No.: 09/498,250

(22) Filed: Feb. 3, 2000

(51) Int. Cl.[7] ..... B28D 1/04

(52) U.S. Cl. ..... 125/13.01; 451/450; 451/456; 125/14

(58) Field of Search ..... 451/451, 452, 451/453, 454, 455, 456, 457; 125/12, 13.01, 14

(56) References Cited

U.S. PATENT DOCUMENTS 5,167,215 A * 12/1992 Harding, Jr. ..... 451/456
5,215,071 A * 6/1993 Mertes et al. ..... 125/13.01
5,381,780 A * 1/1995 Yelton et al. ..... 125/13.01
5,477,844 A * 12/1995 Meister ..... 125/13.01
5,564,408 A * 10/1996 Bassols ..... 125/12
5,669,371 A * 9/1997 Rupprecht et al. ..... 125/13.01
6,099,080 A * 8/2000 Hirashita et al. ..... 125/13.01

* cited by examiner

*Primary Examiner*—Derris H. Banks
(74) *Attorney, Agent, or Firm*—Dick and Harris

(57) ABSTRACT

A road surface cutting system capable of cutting a hole into both cold asphalt and dry concrete surfaces towards the deployment and securement of roadway marking devices. The cutting of the surfaces is without lubrication being applied to the road surface and using air to cool the cutting blades.

13 Claims, 3 Drawing Sheets

ROAD SURFACE CUTTING SYSTEM AND METHOD FOR PERFORMING SAME

BACKGROUND OF THE INVENTION

The present invention relates in general to a road surface cutting system and in particular to a road surface cutting system capable of cutting a hole into both cold asphalt and dry concrete surfaces without lubrication being applied to the road surface and cutting blades—instead using air to cool the cutting blades.

The boundaries of roadways are commonly defined and marked by either safety reflectors or raised lane dividers positioned along the sides of the road and between driving lanes. These reflectors and lane dividers are not merely placed upon the surface of the roads but are actually inserted into the roads themselves. To insert these reflectors and lane dividers into the road, holes are cut into the road into which the reflectors and lane dividers are then placed and glued into position.

The holes have historically been cut into the road through the use of a cutting system mounted upon a truck that travels down the road and periodically lowers a set of spinning circular cutting blades. These cutting blades are normally made from steel with industrial diamonds adhered to and surrounding the diameter of the blades thereby forming the cutting surface. However, not all blades will effectively cut all types of road materials. The blades that effectively cut asphalt do not work as well on concrete and those that cut concrete are not as effective on asphalt. Accordingly, two different sets of blades are usually required to be carried on the truck depending upon what type of surface, asphalt or concrete, is to be cut.

The need for different sets of blades for different road surfaces causes difficulties in the cutting process. Each set of blades is extremely heavy weighing upwards of three hundred pounds. Therefor, merely the carrying of multiple sets of cutting blades creates a burden. Moreover, changing the blades is no simple procedure incurring significant time, effort and possibly additional equipment. That time, effort and additional equipment makes it unproductive to repeatedly change blades or to change blades on site.

Whether the blades are cutting into asphalt or concrete, as the blades are vertically lowered to engage the road surface, a tremendous amount of heat is created that. The heat created, if left alone, would quickly wear out the blades rendering them useless. Historically, to cool the blades, a liquid, normally water, is applied to the blades and the road as the cutting process takes place. However, the use of water to cool the blades requires that an excessive amount of water be carried on the truck. Furthermore, the use of water in the cooling process also translates into the hole being filling with water and causing difficulty and delay in the insertion of the reflector or lane divider into the hole. The water needs to be evacuated before the reflector or lane divider may be adhered into the hole. This evacuation of the water causes further delay. Delays in the placement of the reflectors and lane dividers are significant since the road or lane is, at least partially, closed during this process rendering it unavailable to traffic. As should be appreciated, closing of certain roads or lanes could create significant traffic problems—especially in congested areas.

It is thus an object of the present invention to create a road cutting system to minimize delay and lane closure caused by the cutting of a road surface and the insertion of a reflector or lane divider.

It is further an object of the present invention to create a road cutting system that does not use liquid to cool the cutting blades.

It is still further an object of the invention to minimize the need to exchange cutting blades depending upon whether the road surface is asphalt or concrete.

These and other objects of the invention will become apparent in light of present specification and drawings.

SUMMARY OF THE INVENTION

The present invention comprises a road surface cutting system, which is capable of cutting a hole into both cold asphalt and dry concrete surfaces towards deploying and securing roadway marking reflectors, without needing lubrication to be applied to the road as it is being cut.

In a preferred embodiment of the road surface cutting system, the system includes a deflection housing which containing the debris generated during the cutting of the hole into the road surface. The deflection housing is orientated so that its bottom is proximate to the roadway surface when the deflection housing is deployed so as to define a cutting region in the road surface creating a boundary for the hole being cut. The deflection housing is also capable of substantially vertical movement towards the road surface as it is being deployed for cutting and away the road surface when the deflection housing is to be removed from the road surface after completion of cutting the hole.

Within the deflection housing is one or more road surface cutting blades. These one or more cutting blades are capable of articulated movement within the deflection housing so as to "float" from a retracted, non-cutting position, when the deflection housing is not adjacent to the road surface, to a deployed cutting position extending beyond the bottom of the deflection housing, when the deflection housing is adjacent to the road surface so as to permit the one or more road surface cutting blades to engage in cutting a hole into the roadway.

Also connected to the deflection housing is a vacuum system for evacuation of debris created by the one or more road surface cutting blades engaging and cutting the road surface. The vacuum system then deposits the debris into a collection container. The vacuum system also simultaneously generates an air flow within the deflection hosng thereby cooling the one or more road surface cutting blades.

In another embodiment, the deflection housing is additionally capable of horizontal movement parallel to the road surface being cut. The deflection housing may also be capable of further leveling adjustment relative to the road surface as the deflection housing is deployed. The further leveling adjustment positions the bottom of the deflection housing juxtaposed with and substantially parallel to the road surface so that the one ore more road surface cutting blades are substantially perpendicular to the said road surface when the one or more road surface cutting blades are in a cutting position.

Preferably the entire road surface cutting system is mounted on a road vehicle. It is also envisioned that the one or more road surface cutting blades are substantially circular blades, each of which is substantially co-planar to each other and rotating around a center point. The center points should be positioned substantially along a common horizontal axis as every other respective center point.

The deflection housing is envisioned as likewise being substantially circular in shape and surrounding one or more substantially circular blades so as to envelop the majority of the one or more substantially circular blades. As such only a portion of the one or more substantially circular blades is capable of protruding out from the bottom of deflection housing towards the road surface to be cut.

In the preferred embodiment, the one or more substantially circular blades actually comprise twenty circular blades. These twenty blades are arranged in a 3-14-3 configuration, where the fourteen middle blades have a smaller diameter than other six outer blades. The fourteen blades all have a common diameter, while the six outer blades also have a common diameter.

As previously indicated, the vacuum system distributes the debris to a debris collection container. The debris collection container is positional in either a collection orientation or a discharge orientation. When transitioning from its collection orientation to its discharge orientation, one end of the container moves upwardly in a vertical direction so as to pivot the collection container about the other end until the container reaches its final discharge orientation.

In another embodiment, the controls for moving the deflection housing vertically, horizontally and through leveling adjustments are located in the cab of the vehicle adjacent to the driver. These controls are located to permit the deflecting housing to be positioned without stopping the vehicle.

In still another embodiment, the road surface cutting system also includes a second vehicle that dispenses adhesive into the hole cut into the road surface. After the adhesive is dispensed into the hole, the second vehicle places the roadway marking reflector into the hole.

In a preferred embodiment, the method of cutting a hole into both cold asphalt and dry concrete surfaces without need for lubrication comprises the steps of: (a) cutting the surfaces with one or more surface cutting blades contained within a deflection housing defining a surface cutting area and preventing debris created by the cutting blades being applied to the surfaces from dispersing into adjacent areas; (b) suctioning and removing said debris from the surface cutting area; (c) collecting the debris from the surface cutting area in a debris collection container; and (d) creating an air flow within the deflection housing capable of cooling the one or more surface cutting blades being applied to the surfaces.

DETAILED DESCRIPTION OF THE DRAWINGS

Figure 1:
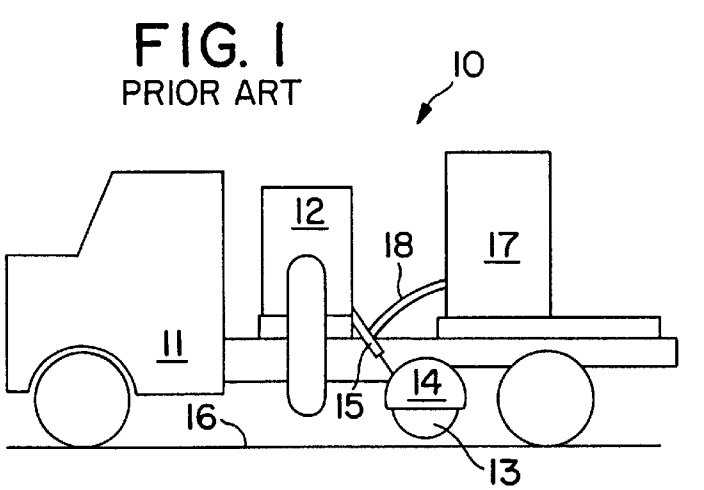
FIG. 1 PRIOR ART
FIG. 1 is a side plan view of a prior art road surface cutting system located upon a vehicle.

While this invention is susceptible of embodiment in many different forms, there is shown in the drawings and will herein be described in detail, several specific embodiments, with the understanding that the present disclosure is to be considered as an exemplification of the principles of the invention and is not intended to limit the invention to the embodiments illustrated.

A prior art road surface cutting system is shown in FIG. 1. Prior art system 10 is shown mounted upon vehicle 11. Prior art system 10 includes a generator and hydraulic system 12 used to power, position and control circular cutting blades 13 as circular cutting blades 13 move vertically towards and away from road surface 16. Circular cutting blades 13 are fixed within protective sheathing 14 that substantially surrounds the upper half of cutting blades 13. In prior art system 10, circular cutting blades 13 comprise twenty blades in a 3-14-3 configuration. The six outside cutting blades all have the same diameter relative to each other. Similarly, the fourteen inside cutting blades all have the same diameter relative to each other. However, the six outside cutting blades have a larger diameter than the fourteen inside cutting blades.

Specifically in prior art system 10, generator and hydraulic system 12 lowers the combination of sheath housing 14 and circular cutting blades 13 vertically towards road surface 16 by extending hydraulic piston 15 so as to engage and cut into road surface 16. As sheath housing 14 and circular cutting blades 13 are being lowered, generator and hydraulic system 12 actuates circular cutting blades 13 to start the spinning motion. Upon actuation of the spinning motion of circular cutting blades 13, lubrication, usually in the form of water, is being applied so as to cool cutting blades 13 during the cutting process. The lubricant flows from tank 17 through tube 18, which continues behind piston 15, into sheath housing 14 and onto spinning cutting blades 13 and the road surface beneath the blades.

As the combination of heath housing 14 and spinning blades 13 are lowered to engage road surface 16 a hole is cut into road surface 16, which then becomes filled with the lubricant that has been cascading over blades 13 to cool them. After the hole has been cut, the combination of sheath housing 14 and blades 13 are removed in a substantially straight vertical line by vertical retracting piston 15. The vehicle then moves to the next location on road surface 16 and starts the process over again.

Figure 2:
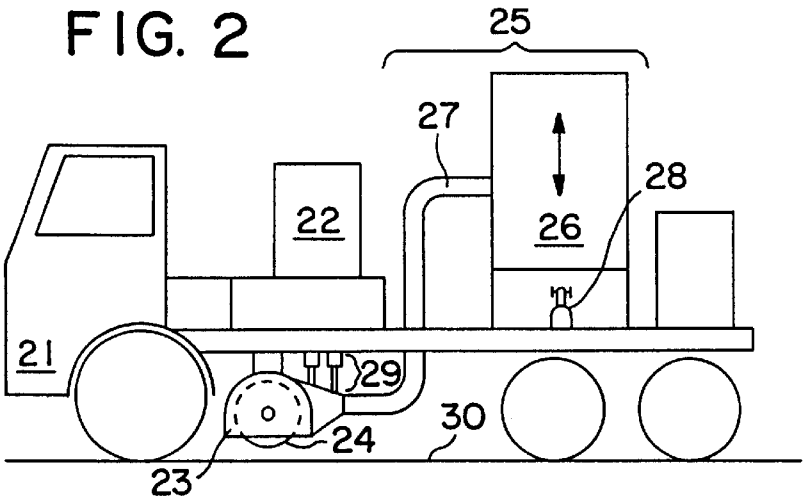
FIG. 2 is a side plan view of the asphalt/concrete cutting system located upon a vehicle of the present invention.

Road surface cutting system 20 of the present invention as mounted on vehicle 21 is shown in FIG. 2. Road surface cutting system 20 comprises generator and hydraulic system and controls 22, deflection housing 23, road surface cutting blades 24 and vacuum system 25. Vacuum system 25 further comprises debris collection container 26 and suction tube 27, which connects deflection housing 23 to debris collection container 26.

In operation, the driver of vehicle 21 positions the vehicle approximate to the location of the road to be cut. The driver then stops vehicle 21 and starts road surface cutting system 20. Generator and hydraulic control systems 22 may be turned on and operated from a location either outside the cab of vehicle 21 so that the driver actually has to stop and park vehicle 21 or inside the cab of vehicle 21 so that the driver may remain inside during the cutting process. Upon activation, generator and hydraulic control systems 22 position deflection housing 24 over the area of road surface 30 in which a who is to be cut. Deflection housing 23 is capable of vertical, horizontal and fine leveling adjustments, relative to road surface 30, through the use of methods known in the industry such as hydraulic piston arrangement 29. As deflection housing 24 is being positioned relative to road surface 30, vacuum system 25 is engaged to create suction and, in turn, an air flow within deflection housing 23. The suction and air flow created by vacuum system 25 accomplishes two purposes, namely cooling of blades 23 as they cut road surface 30 and to evacuate debris from the immediate area of road being cut by blades 23. Debris from road surface 30 is evacuated through suction tube 27 into debris collection container 26.

Figure 4:
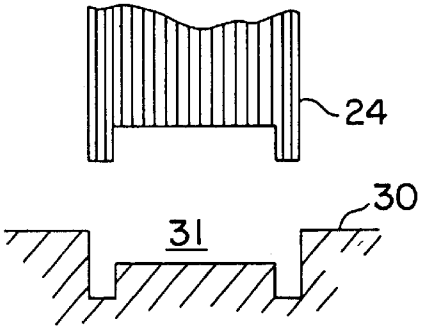
FIG. 4 is a front plan view of the twenty circular cutting blades and the hole formed in the road surface by those blades.

As in the prior art system, road surface cutting blades 24 comprise twenty circular blades having a same common center point. Cutting blades 24 are configured differently than the prior art however. As shown in FIG. 4, in the present invention, circular cutting blades 24 are positioned in a 3-14-3 configuration, where the six outside cutting blades all have the same diameter relative to each other. Similarly, the fourteen inside cutting blades all have the same diameter relative to each other. The six outside cutting blades have a larger diameter than the fourteen inside cutting blades, but all of the blades spin around a common center point. Cutting blades 24 are then substantially surrounded by deflection housing 23. As further shown in FIG. 4, the adjustability of deflection housing 23 in multiple directions, not just vertically as in the prior art, relative to road surface 30 permits blades 23 to be in a cutting position that is substantially perpendicular to road surface 30, to, in turn, effect a truer, cleaner hole 31 and lessen wear on cutting blades 23.

Figure 8A:
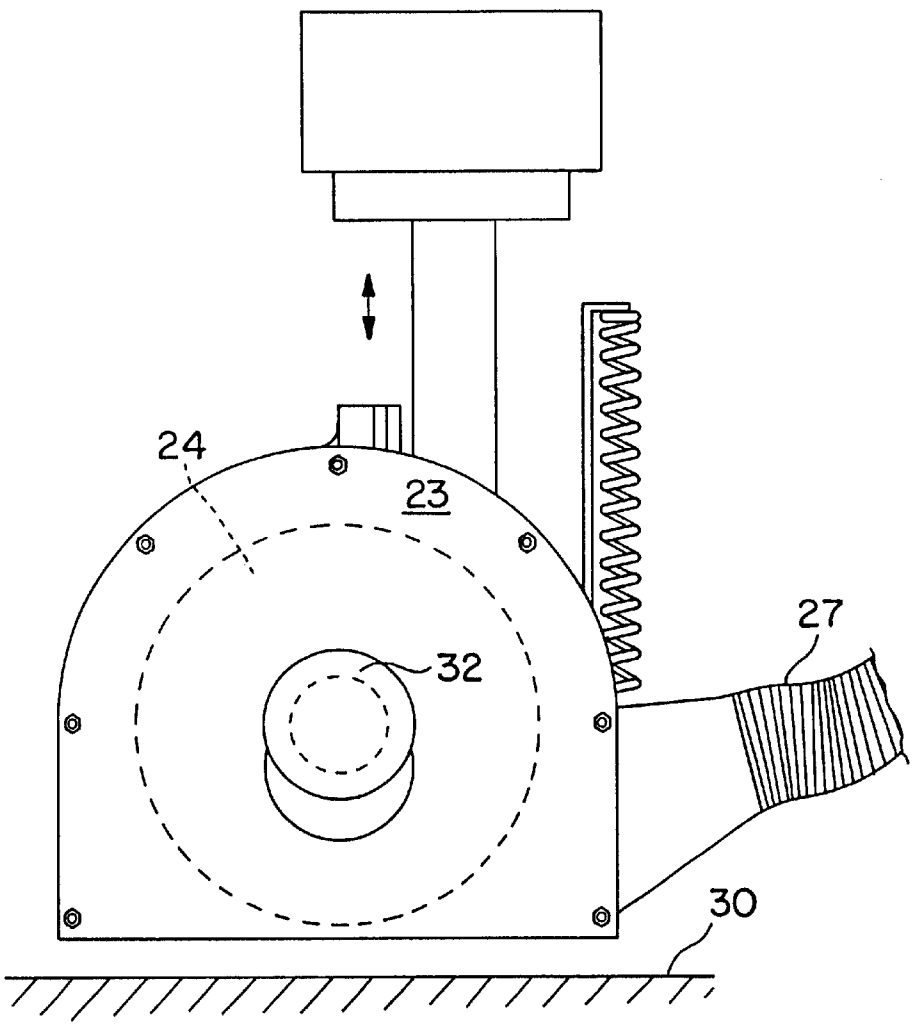
FIG. 8A is side plan view of the deflection housing in a retracted non-cutting orientation.
Figure 7A:
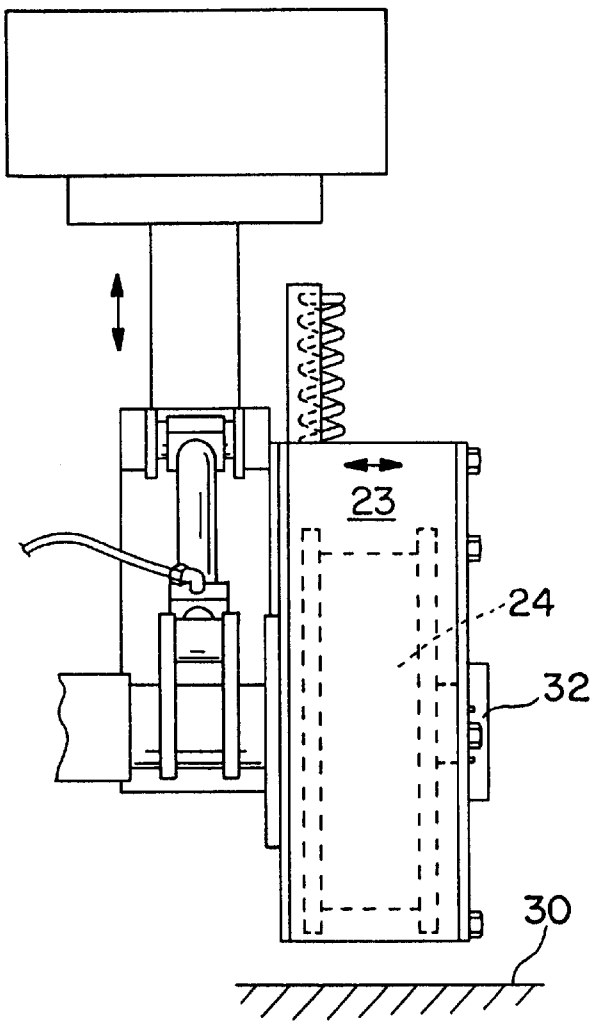
FIG. 7A is front plan view of the deflection housing in a retracted non-cutting orientation.
Figure 8B:
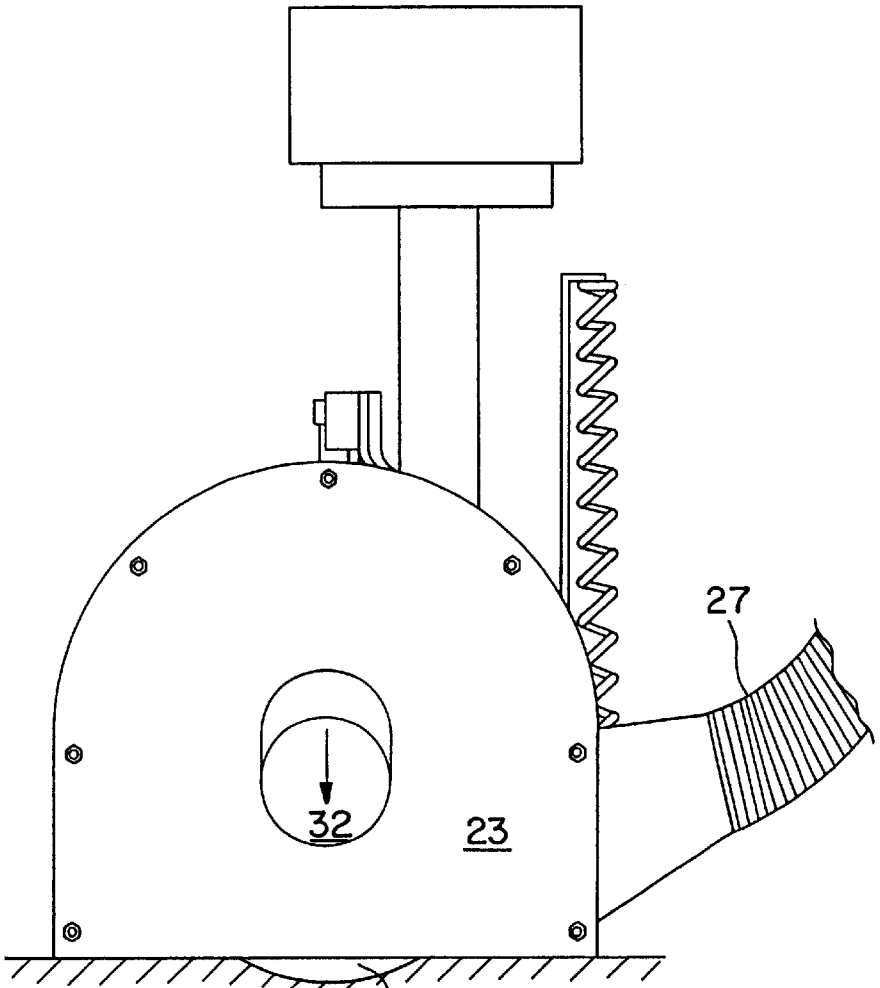
FIG. 8B is a side plan view of the deflection housing in a deployed, road surface cutting orientation.
Figure 7B:
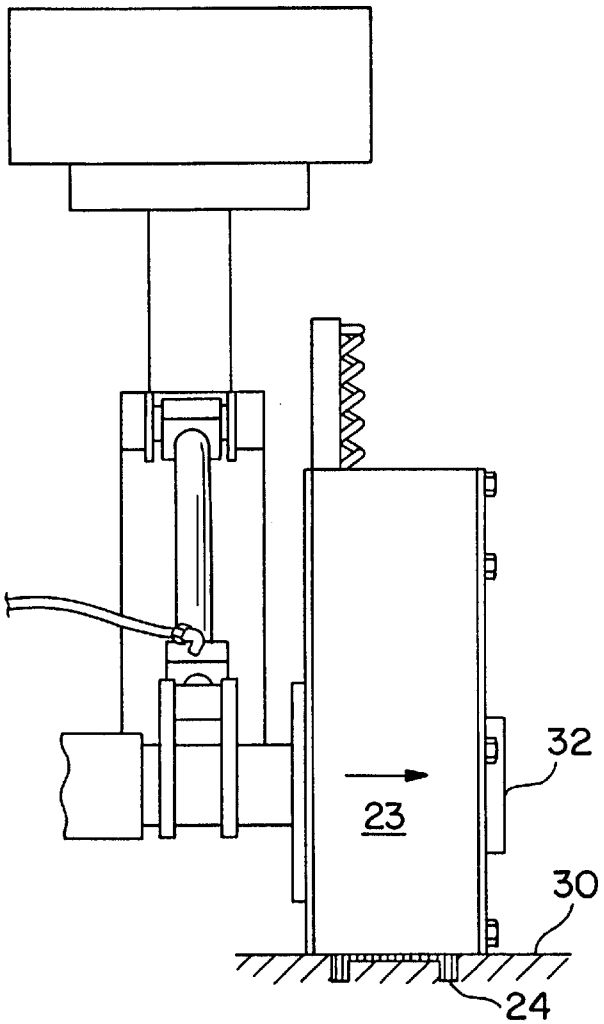
FIG. 7B is a front plan view of the deflection housing in a deployed, road surface cutting orientation.

As shown in FIGS. 7A–B and 8A–B, cutting blades 24 are fixed so as to create a cutting action by spinning around center hub 32. However, the entire configuration of cutting blades 24 are movable vertically within deflection housing 23 so as to "float" therewithin. Specifically, cutting blades 24 transfers from a retracted position where the entirety of the blades are within deflection housing 23 to a deployed cutting position where a portion of the blades extend past the bottom of deflection housing 23 and engage or cut into road surface 30. Cutting blades 23 are deployed and retracted within deflection housing 24 as deflection housing 23 is positioned into a deployed, road cutting arrangement as shown in FIGS. 7B and 8B from a retracted, noncutting position as shown in FIGS. 7A and 8A.

FIGS. 7A and 8A show deflection housing 23 in the process of transitioning from a fully retracted, non-cutting orientation to a fully deployed, cutting orientation of FIGS. 7B and 8B. Piston arrangement 29, which is of a type known to the industry, moves deflection housing 23, and in turn, cutting blades 24, both vertically and horizontally until deflection housing 23 is properly position adjacent to road surface 30 desired to be cut. When deflection housing 23 is proximate to road surface 30, fine leveling adjustments are made to the orientation position of deflection housing 23 so as to operably position cutting blades 24 substantially perpendicular to road surface 24 prior and during the cutting process. Once hole is cut in road surface 30, the process is reversed so as to retract both cutting blades 24 and deflection housing 23.

Figure 3:
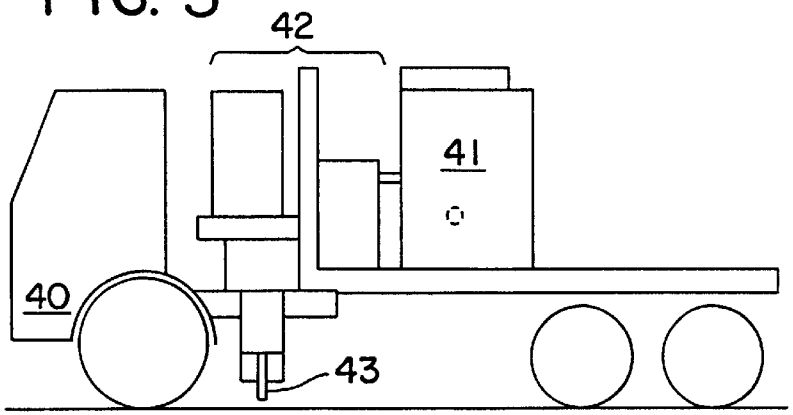
FIG. 3 is a side plan view of a second vehicle containing the adhesive applying device of the present invention.
Figure 5:
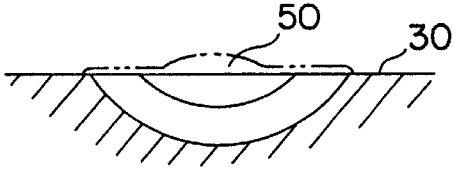
FIG. 5 is a cross-sectional view of the roadway marking device of FIG. 6.
Figure 6:
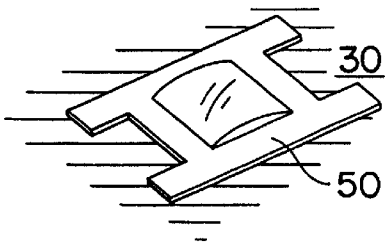
FIG. 6 is a top perspective view of a roadway marking device positioned within the hole cut in the road surface by the present invention.

After hole 31 has been cut, the driver of a second vehicle 40 positions the vehicle over hole 31. Due to the vacuum system 25, hole 31 is free of substantially all debris and ready for receipt of adhesive to secure a roadway marking device, such as a lane divider reflector, in place within hole 31. Second vehicle 40 containing an adhesive application device is shown in FIG. 3. Unmixed adhesive of the type known in the industry, such as epoxy, is carried in heater tanks 41. After the driver of vehicle 41 has positioned dispensing nozzle 43 over hole 31, the driver releases some of the unmixed epoxy through mixing system 42 so as to eventually emanate from dispensing nozzle 43 into hole 31. A roadway marking device is then placed in hole 31 and allowed to be fixed in position by the adhesive. A roadway marking device, specifically a lane divider reflector, fixed in position within hole 31 is shown in FIGS. 5 and 6.

Debris that has accumulated in debris collection container 26, of course, needs to be emptied at some point. Extending piston 28 (FIG. 2) raises one end of debris collection container 26 so as to pivot about the other end. This pivoting motion and raising of one end of debris collection container 26 dumps debris for container 26 and permits easy emptying. Piston 28 is then retracted so as to lower container 26 to a debris collection orientation. System 20 is then ready to be used again.

The foregoing description and drawings merely explain and illustrate the invention and the invention is not limited thereto except as the appended claims are so limited, as those skilled in the art who have the disclosure before them will be able to make modifications and variations therein without departing from the scope of the invention.

What is claimed is:

1. A road surface cutting system, which is capable of cutting a hole into both cold asphalt and dry concrete surfaces for the deployment and securement of roadway marking devices, without the need for lubrication to be applied to said road surface being cut, said road surface cutting system comprising:

a deflection housing for containing debris generated from said hole being cut into said road surface;

said deflection housing having a top portion and a bottom portion where said bottom portion is proximate to said roadway surface when said deflection housing is deployed, wherein said bottom portion defines a cutting region on said road surface when said hole is being cut;

said deflection housing being capable of substantially vertical movement towards said road surface when said deflection housing is being deployed proximate said road surface and capable of substantially vertical movement away from said road surface when said deflection housing is to be removed from said road surface;

one or more road surface cutting blades operably positioned within said deflection housing and being powered to cut said holes into both cold asphalt and dry concrete surfaces;

said one or more road surface cutting blades being capable of articulated movement within said deflection housing from a retracted non-cutting position, when said deflection housing is not being deployed proximate to said road surface, to a deployed cutting position extending beyond said bottom portion of said deflection housing, when said bottom of said deflection housing is proximate to said road surface and said one or more cutting road surface cutting blades are engaged in cutting said hole into said roadway;

said deflection housing being operably connected to a vacuum system for evacuation of debris from an area proximate to said one or more road surface cutting blades, when said one or more road surface cutting blades are being deployed, and deposited into a debris collection container; and said vacuum system simultaneously generating a flow of air within said deflection housing so as to cool said one or more road surface cutting blades.

2. The road surface cutting system according to claim 1 wherein said deflection housing is additionally capable of substantially horizontal movement relative to and substantially parallel with said road surface to be cut.

3. The road surface cutting system according to claim 2 wherein said deflection housing is capable of further leveling adjustment relative to said road surface when said deflection housing is being deployed so that said bottom portion of said deflection housing is juxtaposed with and substantially parallel to said road surface, said further leveling adjustment operably positioning said deflection housing so that said one ore more road surface cutting blades are substantially perpendicular to said road surface when said one or more road surface cutting blades are in a deployed cutting position.

4. A road surface cutting system, which is capable of cutting a hole into both cold asphalt and dry concrete surfaces for the deployment and securement of roadway marking devices, without the need for lubrication to be applied to said road surface being cut, said road surface cutting system comprising:

a deflection housing for containing debris generated from said hole being cut into said road surface;

said deflection housing having a top portion and a bottom portion where said bottom portion is proximate to said roadway surface when said deflection, wherein said bottom portion defines a cutting region on said road surface when said hole is being cut;

said deflection housing being capable of substantially vertical movement towards said road surface when said deflection housing is being deployed proximate said road surface and capable of substantially vertical movement away from said road surface when said deflection housing is to be removed from said road surface;

said deflection housing being additionally capable of substantially horizontal movement relative to and substantially parallel with said road surface to be cut so as to operably position said deflection housing over said road surface to be cut;

one or more road surface cutting blades operably positioned within said deflection housing and being powered to cut said holes into both cold asphalt and dry concrete surfaces;

said one or more road surface cutting blades being capable of articulated movement within said deflection housing from a retracted non-cutting position, when said deflection housing is not being deployed proximate to said road surface, to a deployed cutting position extending beyond said bottom portion of said deflection housing, when said bottom of said deflection housing is proximate to said road surface and said one or more cutting road surface cutting blades are engaged in cutting said hole into said roadway;

said deflection housing being capable of further leveling adjustment relative to said road surface when said deflection housing is being deployed so that said bottom portion of said deflection housing is juxtaposed with and substantially parallel to said road surface, said further leveling adjustment operably positioning said deflection housing so that said one ore more road cutting blades are substantially perpendicular to said road surface when said one or more road cutting blades are in a deployed cutting position.

said deflection housing being operably connected to a vacuum system for evacuation of debris from an area proximate to said one or more road surface cutting blades, when said one or more road surface cutting blades are being deployed, and deposited into a debris collection container; and said vacuum system simultaneously generating a flow of air within said deflection housing so as to cool said one or more road surface cutting blades.

5. The road surface cutting system according to claim 4 wherein said road surface cutting system is mounted on a road vehicle.

6. The road surface cutting system according to claim 5 wherein one or more road surface cutting blades comprise one or more substantially circular blades, each of said one or more substantially circular blades being substantially co-planar to each other and rotating around a center point, which is positioned substantially along a common horizontal axis as every other respective center point.

7. The road surface cutting system according to claim 6 wherein said deflection housing is substantially circular in shape and operably position about said one or more substantially circular blades so as to envelop the majority of said one or more substantially circular blades thereby leaving only a portion of said one or more substantially circular blades being capable of protruding out from said bottom portion of deflection housing downwardly towards said road surface to be cut.

8. The road surface cutting system according to claim 7 wherein said one or more substantially circular blades comprise twenty circular blades, fourteen middle blades of said twenty circular blades having a smaller diameter than six outer blades of said twenty circular blades, said twenty circular blades operably positioned within said deflection housing so that fourteen middle blades of said twenty circular blades all have a common diameter which is smaller than six outer blades of said twenty circular blades and arranged so that said fourteen outer blades are between two sets of three of said six outer blades, respectively.

9. The road surface cutting system according to claim 4 wherein said debris collection container being positionable in at least a collection orientation and a discharge orientation, said debris collection container further includes a first end and second end, where said second end is capable of substantially vertical transition from said collection orientation to, in turn, pivot said debris collection container about said first end so as to position said debris collection container into said discharge orientation so as to discharge said debris from said debris collection container.

10. The road surface cutting system according to claim 9 wherein said controls for at least one of said vertical movement, horizontal movement and further leveling adjustment of said deflection housing capable of being controlled by said driver without stopping said road vehicle.

11. The road surface cutting system according to claim 4 wherein controls for said vertical movement, horizontal movement and further leveling adjustment of said deflection housing are located proximate a driver's location.

12. The road surface cutting system according to claim 4 in which said system further includes a second vehicle following said road vehicle, for automatically dispensing adhesive into said hole being cut into said road surface.

13. The road surface cutting system according to claim 12 wherein said second vehicle further includes means for inserting said roadway marking devices into said whole being cut into said road surface.

* * * * *